US010039356B1

(12) United States Patent
Chen

(10) Patent No.: US 10,039,356 B1
(45) Date of Patent: Aug. 7, 2018

(54) LUGGAGE BOARD STRUCTURE

(71) Applicant: Tsung-Chi Chen, Taichung (TW)

(72) Inventor: Tsung-Chi Chen, Taichung (TW)

( * ) Notice: Subject to any disclaimer, the term of this patent is extended or adjusted under 35 U.S.C. 154(b) by 0 days.

(21) Appl. No.: 15/626,727

(22) Filed: Jun. 19, 2017

(51) Int. Cl.
*A45C 5/00* (2006.01)
*A45C 5/14* (2006.01)
*A45C 5/03* (2006.01)

(52) U.S. Cl.
CPC ..... *A45C 5/14* (2013.01); *A45C 5/03* (2013.01); *A45C 2005/037* (2013.01)

(58) Field of Classification Search
CPC ..... A45C 2005/037; A45C 2005/032; A45C 2005/035; A45C 5/14; A45C 5/141
USPC .... 280/37, 47.34, 47.26; 190/122, 124, 127, 190/125, 126, 15.1
See application file for complete search history.

(56) References Cited

U.S. PATENT DOCUMENTS 4,610,333 A * 9/1986 Seynhaeve ..... A45C 5/14 190/115
5,351,792 A * 10/1994 Cohen ..... A45C 5/14 190/18 A
5,480,169 A * 1/1996 Wang ..... A45C 5/14 16/29
5,482,147 A * 1/1996 Wang ..... A45C 5/14 190/115
6,119,835 A * 9/2000 Lin ..... A45C 5/14 190/115
6,148,973 A * 11/2000 Chang ..... A45C 5/14 190/115
6,220,412 B1 * 4/2001 Lin ..... A45C 5/14 190/122
6,247,203 B1 * 6/2001 Kuo ..... A45C 13/262 16/113.1
6,283,261 B1 * 9/2001 Sher ..... A45C 5/14 190/122
6,293,378 B1 * 9/2001 Lin ..... A45C 5/14 190/115
6,604,617 B2 * 8/2003 Davis ..... A45C 5/02 190/107
6,612,411 B2 * 9/2003 Nykoluk ..... A45C 5/146 190/115
6,869,086 B2 * 3/2005 Sadow ..... A45C 13/262 190/18 A
7,097,181 B2 * 8/2006 Sadow ..... A45C 13/262 190/18 A
7,252,296 B2 * 8/2007 Miyoshi ..... A45C 5/14 280/37

(Continued)

*Primary Examiner* — Jeffrey J Restifo
(74) *Attorney, Agent, or Firm* — Egbert Law Offices, PLLC

(57) ABSTRACT

A luggage board structure as an improvement to the conventional luggage boards molded in the form of a solid shell and made of a single type of sheet material, which require molding of wheel bases, handle guide bases and other complicated members. The luggage board structure is mainly comprised of a plastic wheel base part, a plastic top and a middle curved surface, wherein the plastic wheel base part has a pair of integrated wheel bases, the plastic top includes an integrated mounting base of handle and the middle curved surface consists of an upper joining edge at the top connecting to the lower joining edge of the plastic top for fixation and a lower joining edge at the bottom connecting to the upper joining edge of the plastic wheel base part for fixation.

3 Claims, 7 Drawing Sheets

(56) References Cited

U.S. PATENT DOCUMENTS

| | | | | |
|---|---|---|---|---|
| 7,461,730 | B2 * | 12/2008 | Costa | A45C 13/262<br>16/113.1 |
| 7,549,652 | B2 * | 6/2009 | Wu | A45C 5/14<br>160/80 |
| 7,597,341 | B2 * | 10/2009 | Russo | A45C 5/143<br>190/18 A |
| 7,861,834 | B2 * | 1/2011 | Gorga | A45C 5/146<br>190/115 |
| 7,984,797 | B1 * | 7/2011 | Bieber | A45C 13/36<br>190/122 |
| 8,191,908 | B2 * | 6/2012 | Udall | A45C 5/14<br>280/47.25 |
| 9,549,597 | B2 * | 1/2017 | Meersschaert | A45C 5/03 |
| 9,675,154 | B2 * | 6/2017 | Tong | A45C 13/36 |
| 9,801,440 | B2 * | 10/2017 | Hogan | A45C 5/14 |
| 2014/0311844 | A1 * | 10/2014 | Meersschaert | A45C 5/02<br>190/122 |

* cited by examiner

LUGGAGE BOARD STRUCTURE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to the local structure of a form of luggage, and more particularly to an innovative structural design of luggage board.

2. Description of Related Art Including Information Disclosed Under 37 CFR 1.97 and 37 CFR 1.98

The commonly used structural design of luggage boards, as is known to all, is a solid shell made of a piece of plastic sheet material by hot pressing and cutting; or, it is a solid shell made of a piece of metal sheet material by stamping and cutting.

Despite the aforementioned molding methods, the commonly used luggage boards have the same problems; in the molding process of the luggage boards, space on the side of a luggage board corresponding to the wheels must be reserved for mounting holes of wheels, while the side corresponding to the handle must have a mounting hole of handle, wherein, each mounting hole of wheel, for installation, must have a molded wheel base and an internal positioning base because the positioning bolt of the wheel base must be firmly positioned by passing through the luggage board and interlocking with the inner base; the aforementioned mounting hole of handle is designed for installation of the handle, which requires a guide base and an inner locking base; in other words, the conventional structure of the commonly used luggage boards, for installation of wheels and handle, must be put into molding in order to produce the aforementioned complicated wheel bases, inner positioning bases, guide base and inner locking base of handle, which, consequently, significantly increases the manufacturing costs.

Thus, to overcome the aforementioned problems of the prior art, it would be an advancement in the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The "luggage board structure" of the present invention is a creative and special structure of art of technology mainly comprised of the described plastic wheel base part, plastic top and middle curved surface. Compared to the commonly used structures (of the conventional art), the present invention provides an integrated structure consisting of a lower board and wheel bases at the bottom of the luggage board with the described plastic wheel base part and integrates the board structure at the top of a luggage board and the mounting structure of holder with the plastic top at the top of the luggage board. Therefore, compared to the commonly used structures, the present invention reduces the manufacturing and assembly costs arising from molding of multiple sets of said members, which achieves satisfactory industrial and economic efficacy; besides, the luggage board of the present invention is divided into three parts, namely, the plastic wheel base part, plastic top and middle curved surface so that manufacturers can make various attempts with regard to design of textures and colors in the manufacturing process in order to present various patterns of the luggage board and show the practical advancement of meeting diverse demands.

DETAILED DESCRIPTION OF THE INVENTION

Figure 1:
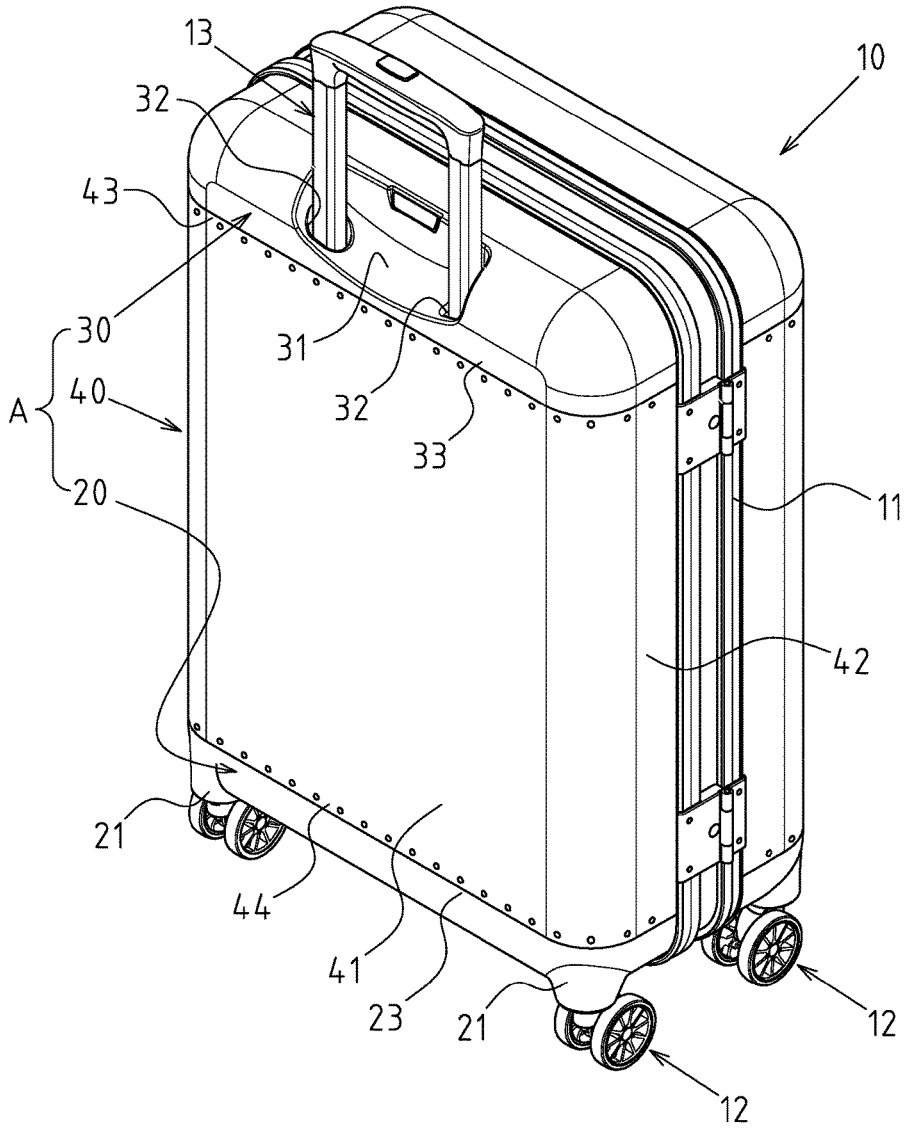
FIG. 1 is an assembled perspective view of a luggage of the preferred embodiment of the present invention.

As shown in FIGS. 1 to 4, it is a preferred embodiment of the luggage board structure of the present invention, provided that the embodiment is only to explain the art of the present invention, but does not attempt to impose any form of restrictions to the present invention in terms of patent application. The luggage board A is mounted on one side of the frame 11 of a luggage 10 to form a board on one side of the luggage 10.

The luggage board A is comprised of the following parts and components: a plastic wheel base part 20 on the lower part of the luggage board A, the plastic wheel base part 20 being equipped with two integrated wheel bases 21 at the bottom with spacing in between, each wheel base 21 having a vertically axial wheel receptacle 22 (used for installing the wheel 12 into the luggage 10), and the plastic wheel base part 20, at the top, having an upper joining edge 23 in a crooked shape on both sides; a plastic top 30 on the upper side of the luggage board A, the plastic top 30 and the plastic wheel base part 20 being upper and lower configurations separated from each other, the plastic top 30 having an integrated mounting base of handle 31, the mounting base 31 consisting of more than one positioning holes 32 (used for mounting and positioning of the handle 13 of the luggage 10; in this embodiment, there are two separated handle positioning holes 32), and the plastic top 30, at the bottom, having a lower joining edge 33 in a crooked shape on both sides; a middle curved surface 40 in the middle of the luggage board A, the middle curved surface consisting of a main board 41 and two integrated side boards 42 with the left and right sides curved backward, the middle curved surface 40 having an upper joining edge 43 in a crooked shape on both sides at the top, the upper joining edge 43 being designed for connecting the lower joining edge 33 of the plastic top 30 and fixed with joining members (see detailed description below), and the middle curved surface 40 having a lower joining edge 44 in a crooked shape on both sides at the bottom, the lower joining edge 44 connecting to the upper joining edge 23 of the plastic wheel base part 20 and fixed with joining members (see detailed description below).

Figure 2:
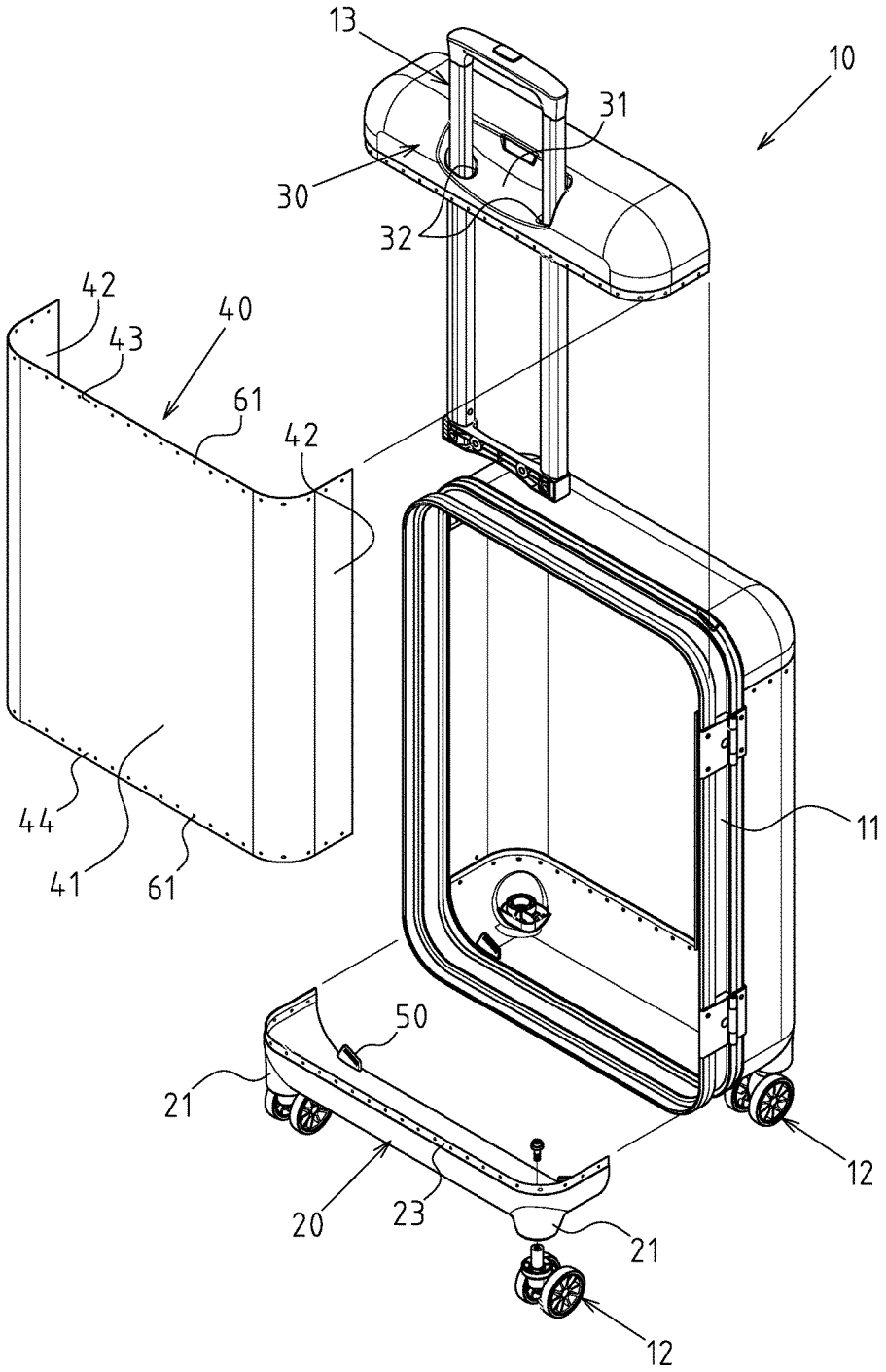
FIG. 2 is an exploded perspective view of the luggage board of the preferred embodiment of the present invention.
Figure 3:
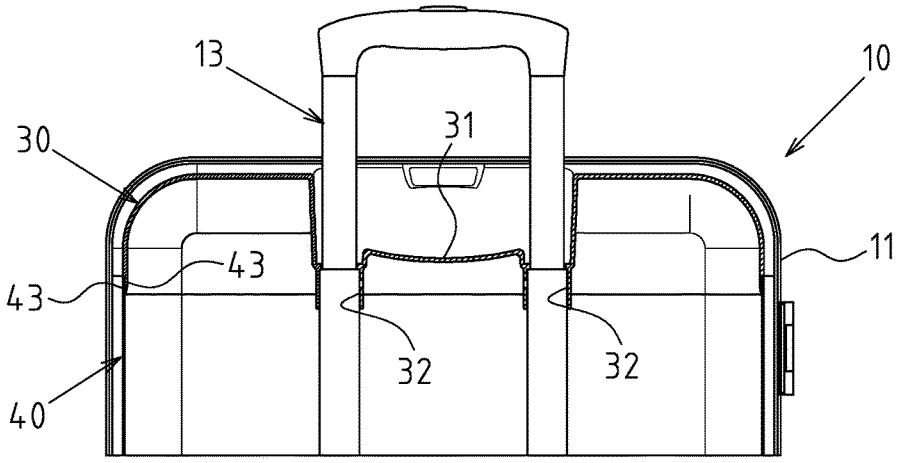
FIG. 3 is the local vertical sectional view (1) of the luggage board of the preferred embodiment of the present invention.
Figure 4:
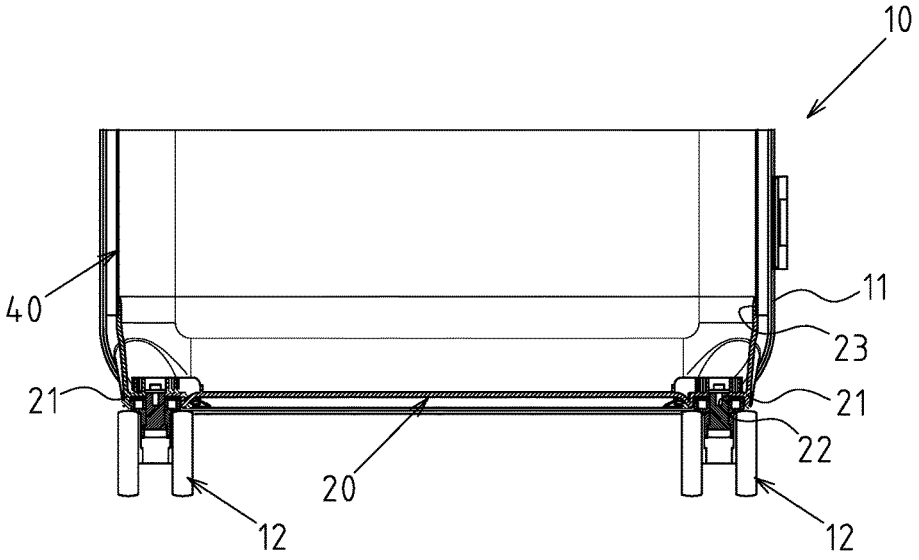
FIG. 4 is the local vertical sectional view (2) of the luggage board of the preferred embodiment of the present invention.
Figure 5:
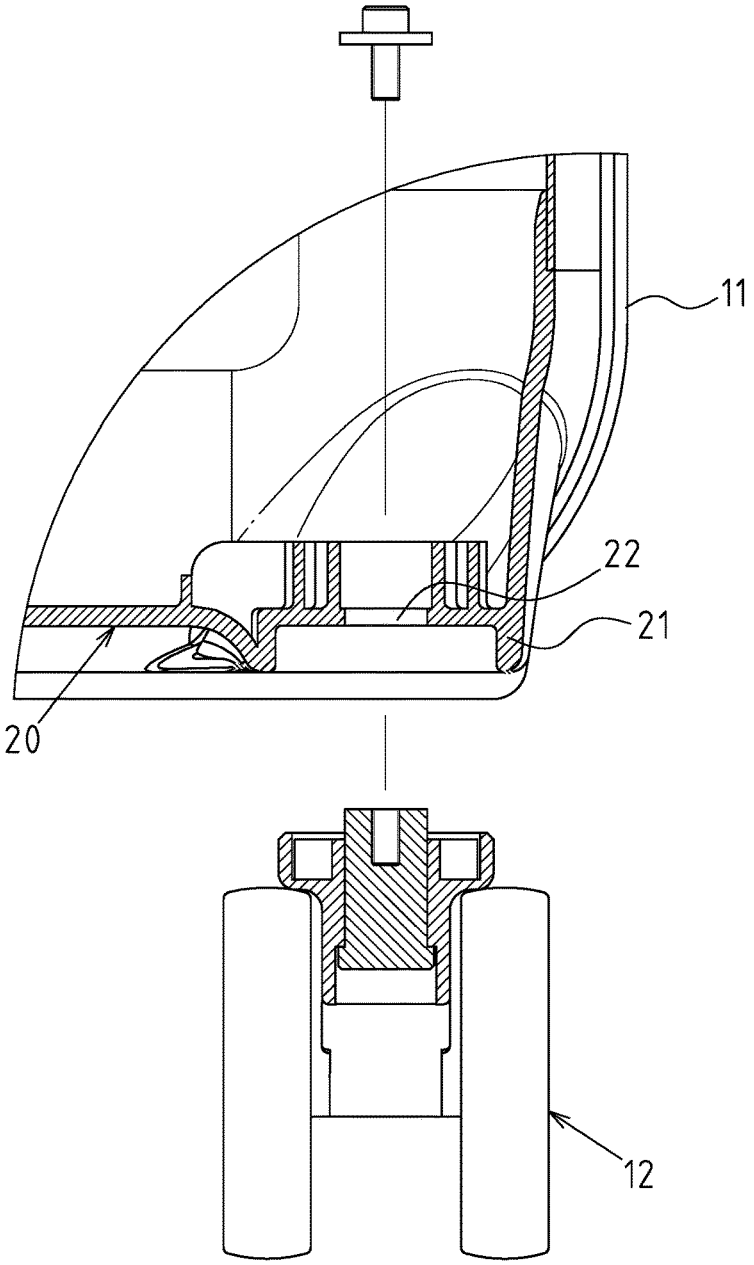
FIG. 5 is the exploded sectional view of local members of the luggage board of the preferred embodiment of the present invention.
Figure 6:
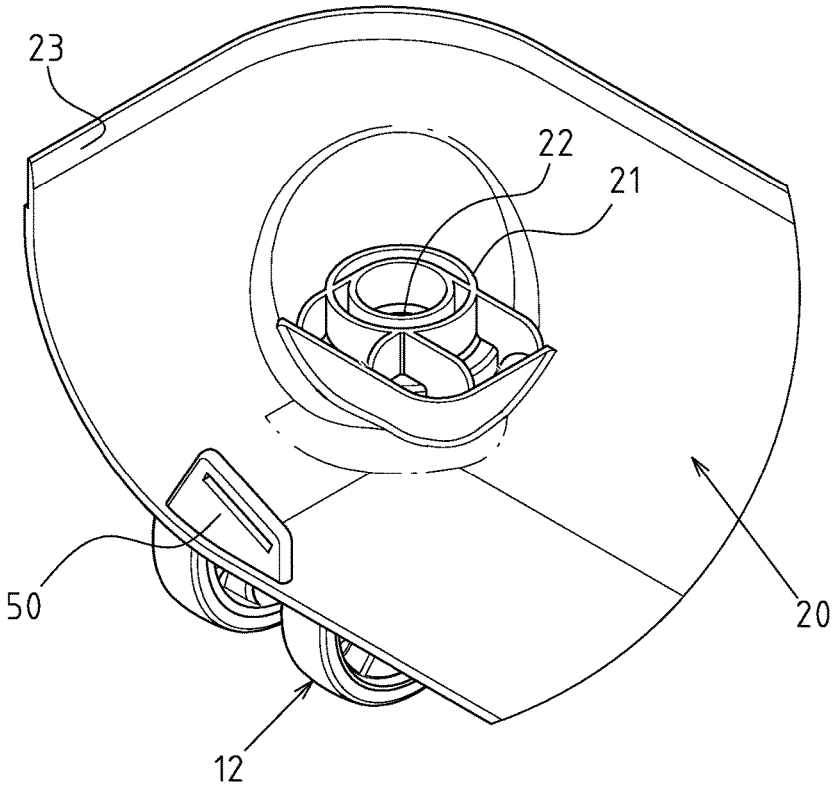
FIG. 6 is the enlarged stereogram of the embodiment of the integrated hook base in the inner wall of the plastic wheel base part of the present invention.

As shown in FIGS. 2 and 6, in the embodiment, the inner wall of the plastic top 30 and the inner wall of the plastic wheel base part 20 form a pair of integrated hook bases 50 separated with each other (in the FIGS. 2 and 6, only the hook base 50 on the plastic wheel base part 20 is shown); the hook base 50 of the embodiment is mainly designed for fastening the hook associated to the movable part of the movable spacer in the luggage 10. Different from the commonly used structures, the hook base 50 of the embodiment is mainly an integrated part in the inner wall of the plastic wheel base part 20, whereas the commonly used hook bases are generally independent parts fixed onto the inner parts of luggage. Therefore, compared to the commonly used hook bases, the design helps reduce the cost of assembly and shows practical advancement.

Figure 7:
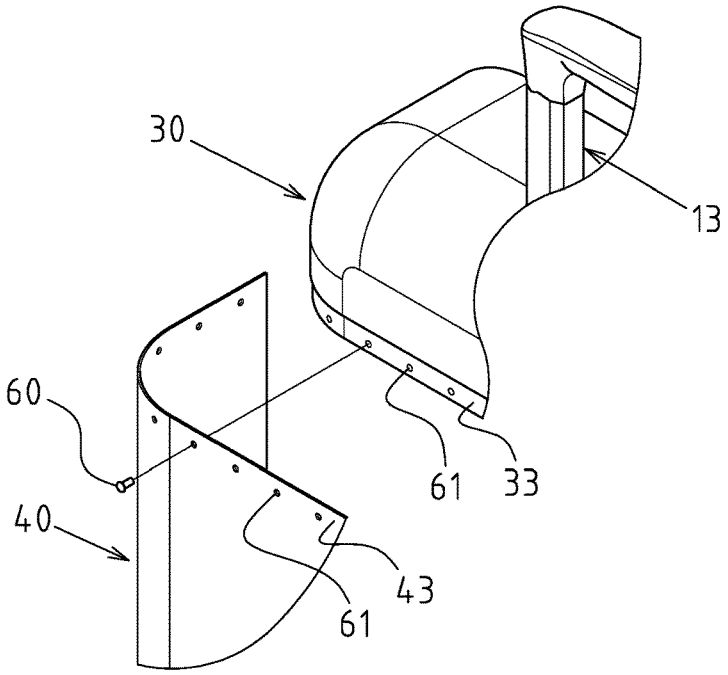
FIG. 7 is the stereogram of the embodiment of rivets as the joining members of the present invention.
Figure 8:
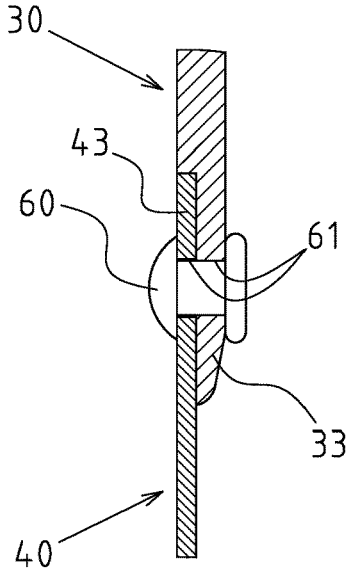
FIG. 8 is the sectional view of the embodiment of rivets as the joining members of the present invention.

As shown in FIGS. 2, 7 and 8, in the embodiment, the middle curved surface 40 is a piece of curved metal sheet material and the described joining members are rivets 60 fastening the upper joining edge 43 and the lower joining edge 33, the lower joining edge 44 and the upper joining edge 23 with arrays of separated rivet holes 61.

Figure 9:
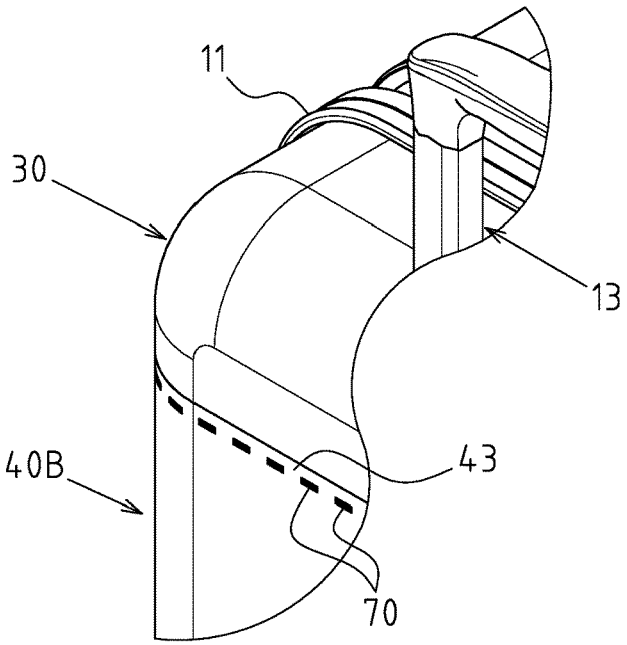
FIG. 9 is the stereogram of the embodiment of machine sewing threads as the joining members of the present invention.
Figure 10:
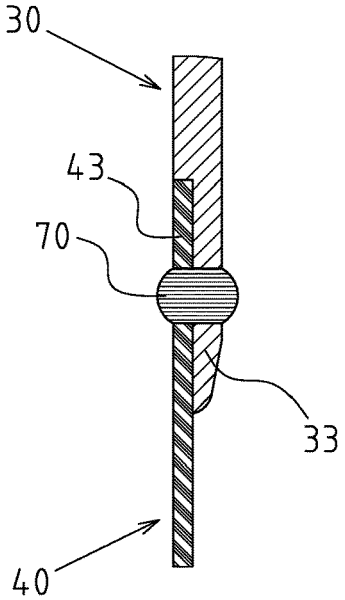
FIG. 10 is the sectional view of the embodiment of machine sewing threads as the joining members of the present invention.

As shown in FIGS. 9 and 10, in the embodiment, the middle curved surface 40B is comprised of a piece of curved plastic sheet material and the described joining members are machine sewing threads 70 fastening the upper joining edge 43 and the lower joining edge 33, the lower joining edge 44 and the upper joining edge 23.

With said structures and technological characteristics, the luggage board A of the present invention is mainly comprised of the described plastic wheel base part 20, plastic top 30 and middle curved surface 40, wherein, the integrated mounting base of handle 31 of the plastic top 30 at the top of the luggage board A has a pair of separated positioning holes 32 designed for installation and positioning of the holder 13 of the luggage 10, and therefore, this part of the present invention integrates the board structure at the top of a luggage board and the mounting structure of holder, which reduces the costs arising from molding of the commonly used holder guide bases and inner locking bases and assembly of these sets of members; the plastic wheel base part 20 has a pair of integrated wheel bases 21 at the bottom and the wheel receptacle 22 of each wheel base 21 is designed for installation of a wheel 12 into the luggage 10 and thus, the part of the present invention provides an integrated structure consisting of a lower board and wheel bases of the luggage board, which reduces the costs arising from molding of the commonly used wheel bases and inner positioning bases and assembly of these sets of members; besides, the luggage board A of the present invention is divided into three parts, namely, the plastic wheel base part 20, the plastic top 30 and the middle curved surface 40, so that manufacturers can make various attempts with regard to design of textures and colors in the manufacturing process, e.g. a design of metal texture of the middle curved surface 40 or an embodiment in different colors of the three parts, in order to present various patterns of the luggage board.

It should be noted that the plastic top 30 has an integrated mounting base of handle 31, and yet, the specific embodiment does not attempt to impose any restrictions to the design of such mounting base 31. Both the built-in fixed mounting base and the external fixed structure are acceptable.

I claim:

1. A luggage board for mounting on one side of a frame of a luggage article to form a board on one side of the luggage article, the luggage board comprising:

a plastic wheel base part equipped with two wheel bases at a bottom thereof with spacing therebetween, each wheel base of the two wheel bases having a vertically axial wheel receptacle, the plastic wheel base part having an upper joining edge with an angled shape on both sides at a top thereof;

a plastic top and said plastic wheel base part being upper and lower configurations separated from each other, said plastic top having a mounting base for a handle, the mounting base having a plurality of positioning holes, said plastic top having a lower joining edge of an angled shape on both sides thereof and at a bottom thereof;

a middle curved surface having a main board and two side boards with the left and right sides curved backwardly, said middle curved surface having an upper joining edge of an angled shape on both sides at a top thereof, the upper joining edge connecting the lower joining edge of said plastic top and fixed with joining members, said middle curved surface having a lower joining edge of a crooked shape on both sides at a bottom thereof, the lower joining edge connecting to the upper joining edge of said plastic wheel base part and fixed with joining members, wherein said middle curved surface is a piece of curved metal sheet material, the joining members being rivets that fasten the upper joining edge and the lower joining edge, the lower joining edge and the upper joining edge having arrays of separated rivet holes that respectively receive the rivets.

2. The luggage board of claim 1, wherein an inner wall of said plastic top and an inner wall of said plastic wheel base part form a pair of hook bases separated with each other.

3. A luggage board for mounting on one side of the frame of a luggage article to form a board on one side of the luggage article, the luggage board comprising:

a plastic wheel base part equipped with two wheel bases at a bottom thereof with spacing therebetween, each wheel base of the two wheel bases having a vertically axial wheel receptacle, the plastic wheel base part having an upper joining edge with an angled shape on both sides at a top thereof;

a plastic top and said plastic wheel base part being upper and lower configurations separated from each other, said plastic top having a mounting base for a handle, the mounting base having a plurality of positioning holes, said plastic top having a lower joining edge of an angled shape on both sides thereof and at a bottom thereof;

a middle curved surface having a main board and two side boards with the left and right sides curved backwardly, said middle curved surface having an upper joining edge of an angled shape on both sides at a top thereof, the upper joining edge connecting the lower joining edge of said plastic top and fixed with joining members, said middle curved surface having a lower joining edge of a crooked shape on both sides at a bottom thereof, the lower joining edge connecting to the upper joining edge of said plastic wheel base part and fixed with joining members, wherein said middle curved surface is a piece of curved plastic sheet material, the joining members being machine sewing threads that fasten the upper joining edge and the lower joining edge.

* * * * *